United States Patent [19]

Okada et al.

[11] Patent Number: 4,929,501

[45] Date of Patent: May 29, 1990

[54] THERMAL TRANSFER MEDIUM

[75] Inventors: Takuji Okada; Kunio Murakami, both of Uji, Japan

[73] Assignee: Stamicarbon B.V., Geleen, Netherlands

[21] Appl. No.: 233,125

[22] Filed: Aug. 17, 1988

[30] Foreign Application Priority Data

Aug. 18, 1987 [JP] Japan ..... 62-206140

[51] Int. Cl.[5] ..... B41M 5/035; B41M 5/26

[52] U.S. Cl. ..... 428/337; 346/76 PH; 400/120; 400/241.1; 428/195; 428/474.4; 428/475.5; 428/910; 428/913; 428/914; 503/227

[58] Field of Search ..... 428/195, 484, 488.1, 428/488.4, 913, 914, 475.5, 332, 337, 474.4, 910; 8/471; 503/227; 400/120, 241.1; 346/76 PH

[56] References Cited

U.S. PATENT DOCUMENTS

| | | | |
|---|---|---|---|
| 4,670,307 | 6/1987 | Onishi et al. | 428/484 |
| 4,690,858 | 9/1987 | Oka et al. | 428/475.5 |
| 4,699,973 | 10/1987 | Ito et al. | 528/335 |
| 4,752,534 | 7/1988 | Koshizuka et al. | 428/484 |
| 4,760,109 | 7/1988 | Chiba | 524/606 |
| 4,777,079 | 10/1988 | Nagamoto et al. | 428/484 |

*Primary Examiner*—Pamela R. Schwartz

*Attorney, Agent, or Firm*—Cushman, Darby & Cushman

[57] ABSTRACT

A thermal transfer medium which has a heat meltable or heatsublimable ink layer on one side of a stretched polyamide film which mainly consists of polytetramethylenediapamide and has a melting point of at least 270° C. The film shows good heat resistance and non-sticking properties.

8 Claims, No Drawings

THERMAL TRANSFER MEDIUM

BACKGROUND OF THE INVENTION

The present invention relates to a thermal transfer medium which comprises a film made essentially of polytetramethyleneadipamide, as a supporting material. The thermal transfer medium does not melt by the heat of a thermal head, and it has excellent properties to prevent sticking to the thermal head. Thermal transfer media find application as typewriter ribbons and other fast printing devices.

For thermal transfer recording, a thermal transfer medium having a heat-meltable ink layer or heat-sublimable ink layer on one side of a polyester film or condenser paper has been used in many cases. The supporting material is heated from the side opposite to the ink layer to transfer the ink to a paper. This conventional method, particularly when a polyester film is used, shows the drawback that the polyester film due to its low heat resistance tends to melt partially by the heat of the thermal head, which at some instances reaches a level as high as about 400° C. This tendency is particularly observed when a heat-sublimable ink is used, since in that case it is necessary to raise the temperature of the thermal head and to prolong the treating time due to the increased energy requirement for sublimation. Further, even if the film does not melt, the contact surface of the supporting material with the thermal head is partially softened and the slip properties tend to deteriorate. A so-called stick phenomenon is likely to occur in that case.

In order to solve these problems, for example, in many cases, a heat-resistant slippery coating is applied on the surface of the supporting material which faces the thermal head as disclosed in Japanese Examined Patent Publication No. 13359/1983. However, it is impossible to avoid the increase of the cost. Further, there remain several problems such as the heat resistant coating layer tending to peel from the supporting material.

The present inventors have conducted extensive research to solve these problems and, as a result, have invented the following thermal transfer medium.

SUMMARY OF THE INVENTION

Namely, the present invention provides a thermal transfer medium which has a heat-meltable or heat-sublimable ink layer on one side of a polymer film wherein the film comprises at least one layer produced of a polyamide or polyamide blend containing at least 60% by weight of tetramethyleneadipamide units and having a melting point of at least 270° C.

DETAILED DESCRIPTION OF THE INVENTION

Now, the present invention will be described in detail. The polytetramethyleneadipamide of the present invention is usually prepared by the polycondensation of tetramethylenediamine with adipic acid and is a compound having a repeating unit of —[NH—$(CH_2)_4$—NH—CO—$(CH_2)_4$—CO]—. However, the process for its production is not critical. It is usual to employ a method wherein a salt of tetramethylenediamine with adipic acid is heated to a temperature of about 200° C. to obtain a prepolymer, and the prepolymer is pulverized and heated under steam for solid phase polymerization. In the case where a copolymer is to be prepared, other components are added at the stage of the preparation of the prepolymer. Further, in the case of blending with another polyamide, it is preferred to employ a melt blending method by means of a single-screw or twin-screw extruder. Further, it is needless to say that a lubricant may be added to improve the sliding properties, and a thermal stabilizer may be added to improve the thermal stability.

Polytetramethyleneadipamide homopolymer is a resin having a melting point of 295° C. and an excellent heat resistance. However, its crystallization speed is so high that the crystallization proceeds already under usual film-forming cooling speeds and it is thereby impossible to stretch the film of homopolymer uniformly. As a measure against this problem, for example, a method is preferred wherein the molten membranous substance is quickly cooled, as disclosed in Japanese Unexamined Patent Publication No. 220731/1985. To further improve the stretching properties (means for decreasing the crystallizability), the polytetramethyleneadipamide can be blended with another polymer, particularly a polyamide, or copolymerized with other monomers, particularly with other polyamide-forming components. Preferred examples of the former (blend type), include compositions of polytetramethyleneadipamide with polyamide 6, polyamide 6.6, polyamide 6.10, polyamide 6.T (polyhexamethyleneterephthalamide), polyamide 8, polyamide 11 and polyamide 12. If the proportion of polytetramethyleneadipamide is too small, its heat resistance or presentability is likely to be insufficient. Therefore, it is necessary that the polytetramethyleneadipamide constitutes at least 60% by weight in the composition.

The copolymer is preferably a copolymer which is obtained by copolymerizing an aminocarboxylic acid component for instance ε-aminocaproic acid, ω-aminododecanoic acid or aminobenzenecarboxylic acid, a lactam component for instance ε-caprolactam or lauryllactam, a diamine component for instance hexamethylenediamine, phenylenediamine or xylylenediamine or a dicarboxylic acid component for instance sebacic acid, azelaic acid, terephthalic acid, isophthalic acid or naphthalenedicarboxylic acid or a mixture thereof to the chain of the polytetramethyleneadipamide. In this case, it is important that the copolymerizable component is used in a proportion of less than 40% by weight and the copolymerized polyamide has a melting point of at least 270° C. If the proportion of the copolymerizable component exceeds 40% by weight, the same problem as in the above mentioned blends occurs. If the melting point is below 270° C., it becomes difficult to form a thermal transfer medium having sufficient heat resistance, which is the object of the present invention. The type of the copolymerization can be for instance a random copolymerization or a block copolymerization. However, when the amount of the incorporated copolymerizable component is large, it is preferred to use a block copolymerization (in that case the lowering of the melting point is as small as possible).

Preferably the proportion of the tetramethyleneadipamide component is at least 80% by weight in both the blend and the copolymer.

Further, the molecular weight of the resin has a substantial effect on the crystallization. If the molecular weight is too small, the crystallization speed tends to be hiqh, whereby it becomes difficult to conduct uniform stretching after the film-forming operation.

As an index for the crystallization speed, it is common to employ the difference between the melting point and the crystallization state. The greater the temperature difference, the slower the crystallization proceeds. The difference between the melting point and the crystallization temperature is determined by means of a differential scanning calorimeter (DSC). The melting point is a melting peak temperature when the temperature is raised at a rate of 20° C./min by means of DSC, and the crystallization temperature is a crystallization peak temperature when the temperature at a level of 20° C. above the melting point is lowered at a rate of 80° C./min. The stretching can satisfactorily be conducted and a uniformly stretched film can be obtained if the temperature difference is at least 30° C., preferably at least 35° C., and at most 60° C., preferably at most 55° C. If the temperature difference is less than 30° C., the crystallization proceeds too fast, whereby it becomes difficult to conduct the stretching uniformly, or to obtain a film having uniform physical properties. On the other hand, if the temperature difference exceeds 60° C., the crystallization tends to be too slow, whereby the heat resistance will be inadequate.

In order to prevent crystallization during the film-forming operation, it is necessary to cool the resin extruded from the die. For polyamides or polyamide blends containing at least 60% by weight of tetramethyleneadipamide units, it is possihle to prevent the crystallization by forming a film at a cooling rate of at least 105° C/sec, preferably at least 120° C./sec within a temperature range of from 10° C. below the melting point to 100° C. below the melting point, whereby it will be possible to conduct the stretching uniformly after the film-forming operation. The stretching temperature is at least 50° C. and at most 220° C., preferably at least 70° C. and at most 170° C. If the temperature is outside the above range, problems such as neck stretching, stretch-breakage or whitening are likely to result, and it becomes difficult to obtain a uniform film. In order to improve the mechanical properties and thermal properties, the stretching ratio should be at least 1.5 and at least monoaxially. It is preferred to hiaxially stretch the film at a stretching ratio of at least 2.

The stretching method is not critical and may be a roll stretching method, a tubular stretching method or a tenter stretching method. However, the most satisfactory result can be obtained by a simultaneously biaxially stretching method. This is attributable to the fact that while in the case of successively biaxially stretching, the hydrogen bond between the polyamide molecular chains formed by the monoaxial stretching hinders uniform stretching in the subsequent transverse stretching operation, such hindrance can be avoided in the case of simultaneously biaxially stretching.

The stretched film is required to have thermal dimensional stability, and it is necessary to thermally fix it within a temperature range from the stretching temperature to the melting point, preferably at least 200° C., at most 280° C. The above-mentioned polyamide is usually used in the form of a monolayet film. However, it may be used in the form of a multi-layer film containing at least one layer of the said polyamide resin. In the case of the multi-layer, it is effective to provide the said polyamide resin laxer on the side of the film facing the thermal head. The thinner the film for the thermal transfer medium, the higher the sensitivity. The thickness is preferably from 2 to 10 μm, since if it is too thin, the strength may be insufficient.

The application of the ink layer on the film may usually be conducted by a hot melt coating method, a gravure coating method, a reverse coating method or the like. When the ink is a heat-meltable type, it is suitably a mixture of pigments with waxes, or a polyester resins or ethylene/vinyl acetate resin. When the ink is a heat-sublimable type, it is suitably a mixture of a sublimable pigment with a resin having a low melting point or a low softening point such as a polyolefin resin, a polyester resin or a vinyl acetate resin. However, they are by no means restricted to such specific examples.

Now, the present invention will he described in more detail by the following Examples and Comparative Examples, however not being restricted thereto.

EXAMPLE 1

A salt of tetramethylenediamine with adipic acid was heated under an elevated pressure at 180° C. for 1.5 hours to obtain a prepolymer. This prepolymer was pulverized and subjected to solid phase polymerization under heating in a steam atmosphere of 260° C. during 20 hours to obtain a polytetramethyleneadipamide resin (melting point: 295° C.). This resin was heated to 300° C. in a 45 mm ϕ extruder and extruded from a T-die and cooled at a rate of 125° C./sec to obtain a non-stretched film having a thickness of 7 μm. The non-stretched film was stretched lengthwise at a stretching ratio of 1.5 by means of a roll heating-type lengthwise stretcher. The film thereby stretched was thermally fixed at 240° C.

Onto this stretched film, a mixture of 10 parts of a paraffin wax, 30 parts of a carnauba wax, 40 parts of an ester wax and 20 parts of a pigment, was hot-melt coated to provide an ink layer having a thickness of 4 μm. The laminated film was microslit and subjected to heat transfer by using a thermal printer (Picoword, manufactured by Brother Industries).

No stick phenomenon between the film and the thermal head took place during the transfer operation, whereby good printing was conducted.

EXAMPLE 2

Eight % by weight of -caprolactam was added to a salt of tetramethylenediamine with adipic acid, and the treatment was conducted in the same manner as in Example 1 to obtain a copolymerized polyamide resin (melting point: 280° C.). This resin was extruded from a T-die in the same manner and cooled at a rate of 125° C./sec to obtain a non-stretched film having a thickness of 40 μm. The non-stretched film was biaxially stretched at a stretching ratio of 3 in each of the lengthwise and transverse directions by means of a tenter-system simultaneously biaxially stretching method, and thermally fixed at 240° C.

Onto this stretched film, a mixture of 10 parts of a paraffin wax, 30 parts of a carnauba wax, 40 parts of an ester and 20 parts of a pigment was hot-melt coated in the same manner as in Example 1 to provide an ink layer having a thickness of 4 μm. The laminated film was microslit, and subjected to thermal transfer by using a thermal printer (Picoword, manufactured by Brother Industries). No stick phenomenon between the film and the thermal head took place during the transfer operation, whereby good printing was conducted.

EXAMPLE 3 AND COMPARATIVE EXAMPLE 1

The proportion of ϵ-caprolactam was changed under the same condition as in Example 2 to obtain copolymerized polyamides.

| | ϵ-caprolactam (wt. %) | Melting point of polyamide (°C.) |
|---|---|---|
| Example 3 | 14 | 270 |
| Comparative example 1 | 17 | 265 |

Films were prepared from these polyamides under the same condition as in Example 2, and subjected to the heat transfer test. No problem occurred in Example 3. However, stick phenomenon between the film and the thermal head took place during the transfer operation in Comparative Example 1.

EXAMPLES 4 AND 5 AND COMPARATIVE EXAMPLE 2

The polytetramethyleneadipamide prepared in Example 1 and nylon 6 (poly-c-capramide) were melt-mixed to obtain three compositions having the proportions of nylon 6 as identified in the following table.

| | proportion of nylon 6 in the composition (wt. %) |
|---|---|
| Example 4 | 20 |
| Example 5 | 40 |
| Comparative Example 2 | 45 |

A film was prepared from each of theses polyamide resins under the same condition as in Example 1, and subjected to transfer test, whereby no problem occurred in Example 4 and 5. However, stick phenomenon between the film and the thermal head took place during the transfer operation in Comparative Example 2.

We claim:

1. Thermal transfer medium which has a heat-meltable or heat-sublimable ink layer on one side of a polymer film, wherein the film comprises at least one layer consisting of polytetramethylene adipamide homopolymer, a polyamide blend containing at least 60% by weight polytetramethylene adipamide or a copolyamide containing at least 60% by weight tetramethylene adipamide units, the polyamide containing layer having a melting point of at least 270° C.

2. Thermal transfer medium according to claim 1, wherein at least 80% by weight tetramethyleneadipamide units are present.

3. Thermal transfer medium according to claim 1, wherein the film is stretched at least uniaxially in the lengthwise direction at a stretching ratio of at least 1.5.

4. Thermal transfer medium according to claim 3, wherein the film is thermally fixed at between 200° and 280° C.

5. Thermal-printer containing a thermal transfer medium according to claim 4.

6. Thermal transfer medium according to claim 1, wherein the film is stretched biaxially in each of the lengthwise and traverse directions with a stretching ratio of at least 2.

7. Thermal transfer medium according to claim 1, wherein the film has a thickness of between 2 and 10 μm.

8. Thermal-printer containing a thermal transfer medium according to claim 1.

* * * * *